US007066381B2

(12) United States Patent
Bundy

(10) Patent No.: US 7,066,381 B2
(45) Date of Patent: Jun. 27, 2006

(54) MAIL INDICATOR

(76) Inventor: William J. Bundy, 784 Valentine Rd., Crownsville, MD (US) 21032

( * ) Notice: Subject to any disclaimer, the term of this patent is extended or adjusted under 35 U.S.C. 154(b) by 0 days.

(21) Appl. No.: 10/886,243

(22) Filed: Jul. 7, 2004

(65) Prior Publication Data

US 2006/0006218 A1 Jan. 12, 2006

(51) Int. Cl.
*A47G 29/12* (2006.01)

(52) U.S. Cl. ..... 232/35

(58) Field of Classification Search ..... 232/35, 232/17, 34

See application file for complete search history.

(56) References Cited

U.S. PATENT DOCUMENTS 1,366,323 A * 1/1921 Maserang ..... 232/35
1,685,874 A * 10/1928 Feist ..... 232/35
2,267,072 A * 12/1941 Beggs ..... 232/17
2,483,992 A * 10/1949 Young ..... 232/35
2,730,298 A * 1/1956 Oscar ..... 232/35
2,843,316 A * 7/1958 Ellis ..... 232/34
2,874,895 A * 2/1959 Opp et al. ..... 232/35
3,338,511 A * 8/1967 Cvar ..... 232/35
3,960,317 A * 6/1976 Clement ..... 232/35
4,147,292 A * 4/1979 Fisher ..... 232/35
4,171,086 A * 10/1979 Hudson ..... 232/35
4,412,646 A * 11/1983 Hollenbach ..... 232/34
6,065,671 A * 5/2000 Stepleton ..... 232/35

* cited by examiner

*Primary Examiner*—William L. Miller
(74) *Attorney, Agent, or Firm*—Robert S. Salzman; Law Office of Robert S. Salzman

(57) ABSTRACT

The invention features a mailbox indicator for determining when the daily mail courier has deposited mail in a rural or suburban mailbox. The mailbox indicator features a pivotal rod, which is pivotally secured to a base. The base is attached to the top of the front end of a mailbox in proximity to, and extending out beyond, the door latch.

2 Claims, 2 Drawing Sheets

MAIL INDICATOR

FIELD OF THE INVENTION

The invention pertains to improvements in mailboxes, and more particularly to an improved mail indicator that notifies the mail recipient when the daily mail has been delivered and deposited into a mailbox.

BACKGROUND OF THE INVENTION

One of the most ubiquitous activities in every day life, is the delivery and retrieval of the daily mail. Most individuals look forward to receiving their daily mail, and often eagerly await the arrival of the mail courier. In rural areas, the mailbox often stands along the roadway, adjacent the homeowner's property. The mailbox is usually fitted with a flag to indicate to the courier, that there are posted letters inside the box. The flag is raised above the box, when the homeowner deposits the posted mail for pick-up. Upon retrieving the posted letters, and delivering the daily mail, the courier pushes the flag back to its neutral, horizontal position. This indicates to the homeowner, that the posted letters have been taken from the box, and that newly arrived mail is present.

On those occasions where the mail recipient has no letters to post, the arrival of the daily mail is non-indicated. Unless the property owner actually catches the exact moment of arrival of the courier, there is absolutely no way to determine that new mail has arrived.

It has occurred to many homeowners, that it would be most advantageous to have a signaling, or indicating device attached to the box, in order to be apprised of the delivery of the daily mail.

Many such devices have been conceived and patented. One of the many drawbacks of past and present mail indicators, is their complexity, unreliability, and their limited line of sight.

In U.S. Pat. No. 627,635; issued to F. C. Bates, for a Postal Box Signal, issued on: Jun. 27, 1899, a mailbox is illustrated having two signal flags. The first flag is used to indicate that posted mail has been taken, and the second flag is displayed in the event that new mail has been deposited. The problem with a two flag system, is the confusion often created between the meaning of the two flag signals. Should there be only one flag standing, does that indicate the retrieval of posted mail, or the delivery of the daily mail? This invention claims to differentiate the flags by color, but at a distance, such distinguishing features can be difficult to discern. In addition, this inventive device has complicated linkage that can be operatively unreliable.

In U.S. Pat. No. 3,648,924; issued to: Burns, on Mar. 14, 1972, for a Mailbox Signal, a two flag mail indicator is shown. The first flag is the traditional flag for posted mail. The second flag indicates the delivery of mail. The second flag is caused to rotate downwardly about a journal pin, when the mailbox door is opened. The problem with this indicator, is that it is difficult to see the second flag, when it swings below the mailbox.

In U.S. Pat. Nos. 3,589,329 and 4,589,329; issued to Schuh and Malik, respectively. Both of these mail indicators feature chain-tethered flags that assume an erect position, when the mailbox door is opened. The problem with chain-tethering is the possibility of linkage entanglement, kinking, and linkage failure.

In U.S. Pat. No. 5,076,337 issued to Reuter on Dec. 31, 1991, for a Mail Arrival Alert for Mailbox, a spring-loaded flag is caused to assume an erect position upon opening of the mailbox. The problem with this system, is that it can be confused with the pop-up flag for posted mail, and spring assisted devices can take a set, or snap. Similar devices are shown in U.S. Pat. Nos. 5,964,401 and 6,575,357 B1.

In U.S. Pat. No. 5,428,206 issued on Jan. 9, 1996 to Waycasy for: Automatic Mail Delivery Signaling Device, a flag is caused to assume an erect position with the opening of the mailbox door. A trigger arm and lever are utilized to provide the flag movement.

In U.S. Pat. No. 4,491,268; issued to Faulkingham on Jan. 1, 1985, for a Mailbox Delivery Signal Device, a brightly colored, spring-loaded, indicator arm is caused to pop-up upon release of the mailbox latch, thus signaling the daily mail delivery.

In U.S. Pat. No. 6,659,357B1, issued to Woelfel, on Dec. 9, 2003, for a Universal Mailbox Flip-flag Indicator, a detachable flag is disposed in the mailbox door. The detachable flag flips into view, when mail is delivered.

It is evident from the vast display of prior art, that what is needed for a mailbox mail delivery-signaling device, is a simple, reliable, and easily discernible indicator.

The present invention provides a simple pivoting rod, that is pivotally attached above the mailbox in proximity to the latched opening. The rod pivots from an upright position, to a benign, horizontal position upon the unlatching of a mailbox door. The very simplicity of the current inventive device will reduce cost, require less parts, and provide reliability. The pivoting rod is decidedly distinct from mail flag indicators, thus eliminating confusion with posted mail indication.

SUMMARY OF THE INVENTION

The invention features a mailbox indicator for determining when the daily mail courier has deposited mail in a rural or suburban mailbox. The mailbox indicator features a pivotal rod, which is pivotally secured to a base. The base is attached to the top of the front end of a mailbox in proximity to, and extending out beyond, the door latch. In a first operative position, i.e. when the mailbox is empty of delivered mail, the rod is in an erect position, and its upper portion extending above the door latch. The rod is colored on its upward portion, i.e. the portion above its pivot point, in order to indicate that the mail has not arrived. In a second operative position, i.e. when the door latch is opened to introduce the daily mail into the mailbox, the rod is caused to pivot into a horizontal position as the latch pushes against the lower portion of the rod. In the horizontal position, the observer cannot see the colored portion of the rod, which now rests in a horizontal cradle of the base. Visual absence of the upright, colored rod indicates that the daily mail has been delivered.

It is an object of the present invention to provide an improved mail indicator.

It is another object of this invention to provide a mail indicator that has minimal moving or working parts, is easy to install, is low in cost, and is reliable.

These and other features and objects of the invention will be more fully understood from the following detailed description of the preferred embodiments considered in conjunction with the accompanying drawings.

BRIEF DESCRIPTION OF THE DRAWINGS

The accompanying drawings, which are incorporated in and form a part of the specification, illustrate the embodiment of the present invention and, together with the description serve to explain the principles of the invention.

DETAILED DESCRIPTION OF THE PREFERRED EMBODIMENT

Generally speaking, the invention comprises a mailbox-indicating device for determining when the daily mail has arrived. The mailbox-indicating device includes a single, pivotally movable element that is attached to a base member that is mounted on top of the mailbox adjacent the door latch. The pivotal element is caused to pivot between an observable and non-observable position in response to the opening of the mailbox door. Delivery of the daily mail (opening of the mailbox door), causes the movable element to pivot to the non-observable position, thus indicating that mail has been delivered.

Figure 1:
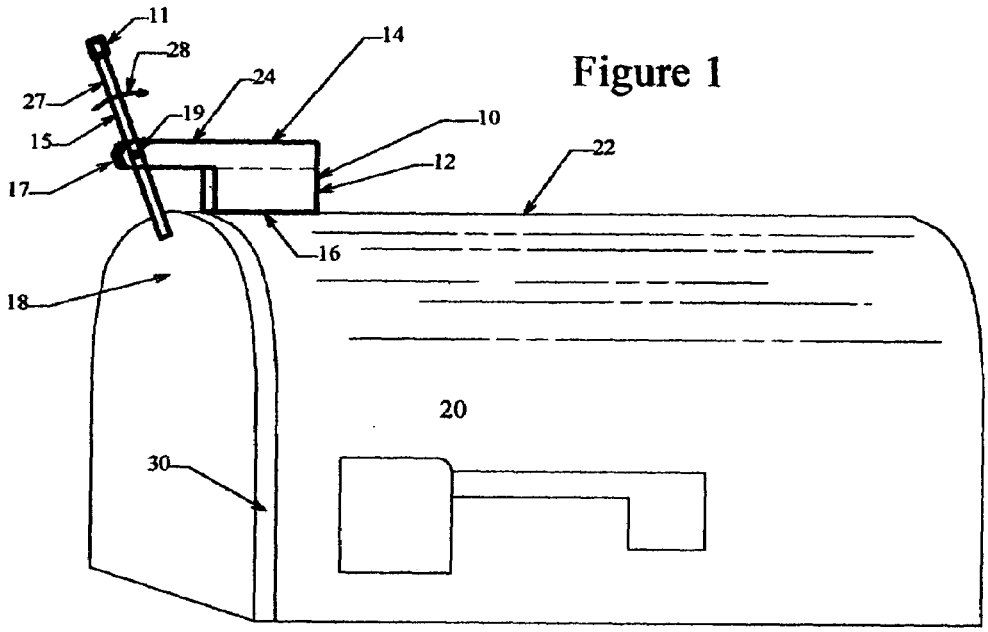
FIG. 1 illustrates an in situ, side view of the mail indicator of this invention in a first operative position.

Now referring to FIG. 1, the mailbox-indicating device 10 is shown in a first operative position, i.e. with an indicator rod 15 in a substantially erect position. The mailbox-indicating device 10 comprises a base member 12 having a groove extending along its top surface 14. The groove accommodates, and hides the indicator rod 15, in its second operative position, as will be observed and explained, with reference to FIG. 2. The bottom 16 of the base member 12 is attached to the top surface 22 of the mailbox 20 adjacent the mailbox door 18, as shown. The base member 12 can be secured to the top surface 14 of mailbox 20, by a pair of self-set screws (not shown). The base member 12 can be made of wood or plastic.

The base member 12 comprises an elongated arm 24, which extends beyond the door 18, as illustrated. The distal end 17 of the elongated arm 24 has a pivot pin 19 extending through, and pivotally engaging with, the indicator rod 15. The arm 15 is operatively pivotal (arrow 28) about pivot pin 19. The indicator arm 15 comprises a brightly colored top portion 11.

Figure 2:
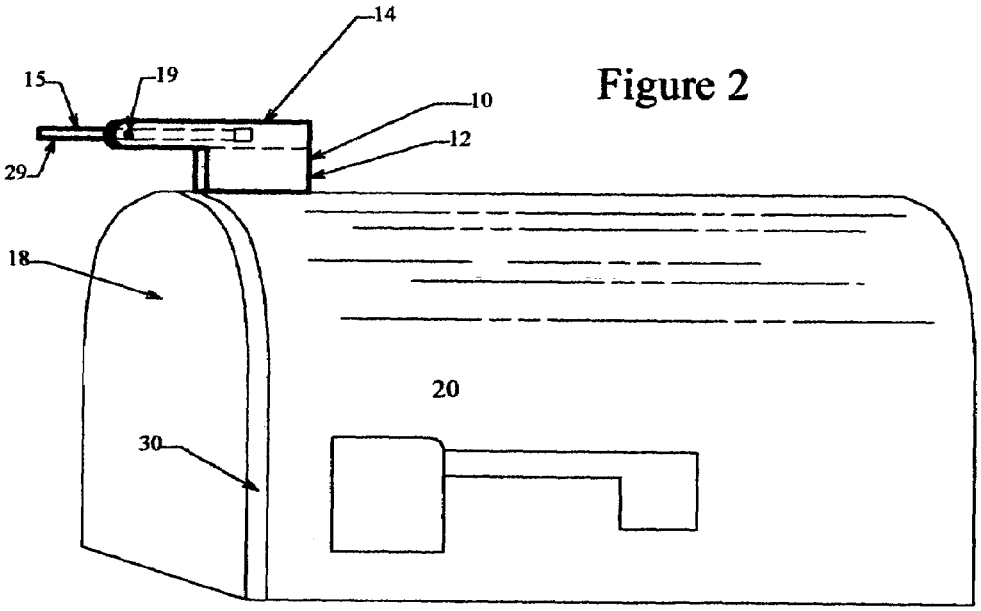
FIG. 2 shows an in situ, side view of the mail indicator of this invention in a second operative position.
Figure 3:
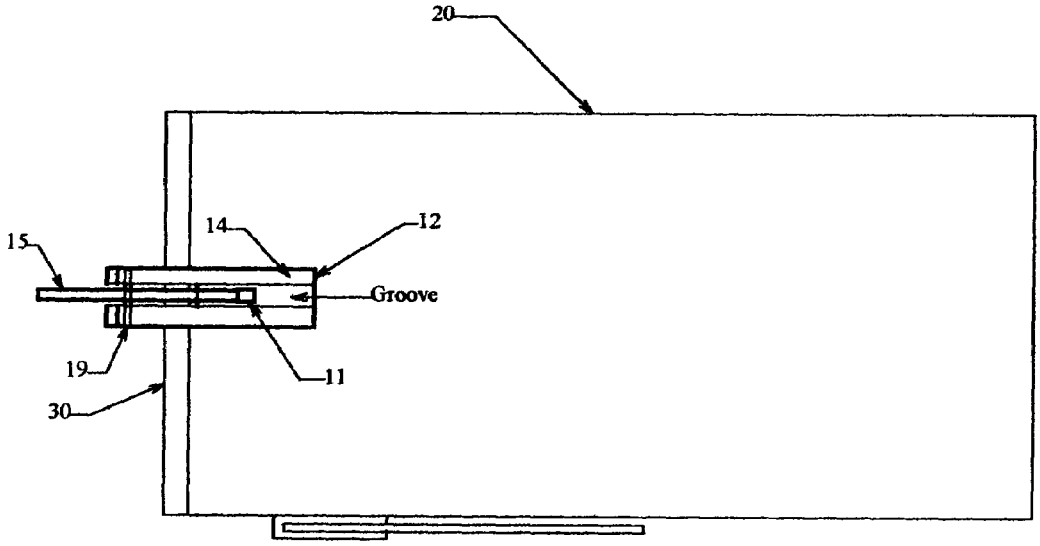
FIG. 3 shows an in situ, top view of the mail indicator of this invention.

Referring to FIG. 2, the mailbox-indicating device 10 is illustrated in a second operative position. It will be observed that the upper portion 27 of the indicator rod 15, with its colored top portion 11, has pivoted into the groove disposed in the top surface 14 of base member 12, and has visually disappeared. It will also be observed that the lower pivotal portion 29 of the indicating rod 15 has now assumed a substantially horizontal position.

OPERATION OF THE INVENTION

Prior to delivery of the daily mail, the indicator rod 15 is positioned in the first operative position, as illustrated in FIG. 1. In this position, the brightly colored top portion 11 of the indicator rod 15 is clearly visible in its upright position. Delivery of the daily mail by the courier, requires that the door 30 of the mailbox 20, be opened. Lower portion 29 of the indicator arm 15 is resting upon door 30. Opening of the door 30, so that the daily mail can be inserted into mailbox 20, forces the lower portion 29 of the indicator rod 15 to pivot (arrow 28) into the substantially horizontal position, depicted in FIG. 2. The colored portion 11 and the upper portion 27 of the indicator rod 15 is now resting in the groove of base member 12. Therefore, the homeowner is able to visually distinguish that the daily mail has arrived.

Upon retrieval of the daily mail, the homeowner resets the indicator arm 15 to the upright position, shown in FIG. 1. In this manner, the mailbox-indicating device 10 is now operationally available for the next day's mail delivery.

In describing a preferred embodiment of the invention illustrated in the drawings, specific terminology has been used for the sake of clarity. However, the invention is not intended to be limited to the specific terms so selected, and it is to be understood that each specific term includes all technical equivalents which operate in a similar manner to accomplish a similar purpose.

Having thus described the invention, what is to be protected by way of Letters Patent, is presented in the appended claims.

What is claimed is:

1. A mailbox-indicating device for determining that the daily mail has been delivered by a courier to the mailbox, comprising:

an elongated base member for supporting an indicating means, said base member being longitudinally secured to a top of said mailbox adjacent a door of said mailbox, said elongated base member including an elongated groove in a top surface thereof, and an arm that extends past said door of said mailbox; and said indicating means including an elongated substantially cylindrical rod being pivotally attached to said arm of said base member at substantially a mid-point of said rod to divide said rod into an upper section and a lower section, said upper section being brightly colored for visual observance, and said rod in operative engagement with said door of said mailbox for movement between an upward extending first visual position and a laterally extending second indicating position, whereby opening said door of said mailbox will engage said lower section of said rod and pivot said rod from said first visual position to said second indicating position such that said upper section of said rod is completely within said groove of said base member thereby completely obscuring said upper section of said rod and thereby indicating that the daily mail has been delivered.

2. A mailbox-indicating device for determining that the daily mail has been delivered by a courier to the mailbox, comprising:

a base member for supporting a substantially cylindrical visual indicator rod, said base member having an elongated groove in a top surface thereof, and said base member being secured to a top of said mailbox adjacent a door of said mailbox; and said visual indicator rod in operative engagement with said door of said mailbox for movement between a first visually observable position and a second visually non-observable position, said visual indicator rod being pivotally attached at substantially a mid-point thereof to said base member, said mid-point dividing the visual indicator rod into an upper section and a lower section, said upper section being brightly colored for visual observance, said visual indicator rod extending upward in said first visually observable position, and extending laterally and partially beyond said mailbox in said second visually non-observable position such that said upper section of said visual indicator rod is completely within said groove of said base member thereby completely obscuring said upper section of said rod and thereby indicating that the daily mail has been delivered.

* * * * *